US007896175B1

(12) United States Patent
Corr et al.

(10) Patent No.: US 7,896,175 B1
(45) Date of Patent: Mar. 1, 2011

(54) WEIGHT ACTIVATED STORAGE DEVICE

(76) Inventors: Steven Corr, Arroyo Grande, CA (US); Steven Clark, Arroyo Grande, CA (US); David Oates, Arroyo Grande, CA (US)

( * ) Notice: Subject to any disclaimer, the term of this patent is extended or adjusted under 35 U.S.C. 154(b) by 562 days.

(21) Appl. No.: 12/018,942

(22) Filed: Jan. 24, 2008

Related U.S. Application Data

(60) Provisional application No. 60/886,357, filed on Jan. 24, 2007.

(51) Int. Cl.
*A47F 5/00* (2006.01)

(52) U.S. Cl. ..... 211/86.01

(58) Field of Classification Search ..... 211/86.01, 211/85.7, 70.5, 13.1, 89.01, 60.1; 248/201; 224/917, 917.5
See application file for complete search history.

(56) References Cited

U.S. PATENT DOCUMENTS 2,720,984 A * 10/1955 Gotowka ..... 211/30
4,213,424 A 7/1980 Hosch et al.
4,232,806 A * 11/1980 Shald ..... 224/406
4,763,797 A 8/1988 Egan
4,798,298 A 1/1989 Ursetta
4,878,585 A * 11/1989 Orestano ..... 211/87.01
5,014,955 A 5/1991 Thompson
5,016,794 A * 5/1991 Beagle, Jr. ..... 224/629
5,027,960 A * 7/1991 Rainville ..... 211/118
5,183,164 A 2/1993 Heinzle
5,322,256 A 6/1994 Kanwischer
5,417,335 A 5/1995 White
5,477,968 A * 12/1995 Largent et al. ..... 211/60.1
5,582,044 A 12/1996 Bolich
5,687,857 A 11/1997 Friedman
5,706,680 A * 1/1998 Wroble ..... 70/18
5,752,638 A * 5/1998 Meeks ..... 224/547
5,788,133 A * 8/1998 Mareno ..... 224/406
5,826,908 A 10/1998 McBride
5,833,078 A * 11/1998 York ..... 211/70.5
5,884,781 A 3/1999 Ehrhart
5,950,844 A * 9/1999 Taylor ..... 211/85.7
6,045,100 A * 4/2000 Shields ..... 248/222.51
6,105,915 A 8/2000 Naman et al.
6,196,397 B1 * 3/2001 Maher ..... 211/85.7
6,253,932 B1 * 7/2001 Lindsey ..... 211/162
6,273,272 B1 * 8/2001 Hake ..... 211/4
6,390,309 B1 * 5/2002 Tucker ..... 211/85.7
6,564,949 B1 * 5/2003 Saathoff ..... 211/70.6
6,629,616 B1 * 10/2003 Heinzle ..... 211/85.7
6,712,226 B1 * 3/2004 Williams, Jr. ..... 211/85.7
6,827,226 B2 12/2004 Coulson
6,886,795 B2 5/2005 Schultz
2002/0060194 A1 * 5/2002 Reiser et al. ..... 211/4
2003/0178382 A1 * 9/2003 Tucker ..... 211/85.7
2003/0196973 A1 * 10/2003 Jacobs ..... 211/85.7
2004/0108286 A1 * 6/2004 Coulson ..... 211/85.7
2006/0289373 A1 * 12/2006 Kahn ..... 211/85.7
2007/0193967 A1 * 8/2007 Ryan et al. ..... 211/70.5
2008/0011694 A1 * 1/2008 Garceau ..... 211/13.1
2008/0083684 A1 * 4/2008 Pfeiffer ..... 211/85.7
2008/0121600 A1 * 5/2008 Korte et al. ..... 211/187
2008/0272159 A1 * 11/2008 Robinson ..... 223/98
2009/0020487 A1 * 1/2009 Wood ..... 211/70.5
2009/0039225 A1 * 2/2009 Taylor ..... 248/316.8
2009/0057251 A1 * 3/2009 Kahn ..... 211/85.7
2009/0095223 A1 * 4/2009 Szutu ..... 119/51.11
2009/0193589 A1 * 8/2009 Carr et al. ..... 5/655
2009/0266629 A1 * 10/2009 Simeray et al. ..... 180/65.51
2010/0016131 A1 * 1/2010 Hoffman ..... 482/121

* cited by examiner

*Primary Examiner* — Sarah Purol
(74) *Attorney, Agent, or Firm* — Philip A. Steiner, Esq.

(57) ABSTRACT

A weight activated storage device is disclosed for retaining elongated objects such as a surfboard or other elongated objects of various sizes and shapes.

19 Claims, 5 Drawing Sheets

WEIGHT ACTIVATED STORAGE DEVICE

CROSS-REFERENCE TO RELATED APPLICATIONS

This non-provisional application claims priority under 35 USC §119(e) to the instant inventors' co-pending provisional patent application Ser. No. 60/886,357 filed on Jan. 24, 2007 and entitled, "Wall Mountable and Weight Activated Retaining Device;" the aforementioned provisional patent application is hereby incorporated by reference in its entirety as if fully set forth herein.

FEDERALLY SPONSORED RESEARCH AND DEVELOPMENT

Not Applicable

REFERENCE TO A MICROFICHE APPENDIX

Not Applicable

RELEVANT INVENTIVE FIELD

The various inventive embodiments described herein relate generally to storage devices and more specifically to wall mounted storage devices for storing for example watersports type boards.

BACKGROUND

Various storage systems are available in the relevant art which provide static receptacles, shelves, hooks and combinations thereof. However, in many circumstances, elongated objects, for example, a surfboard, due to its dimensions, shape and contour are not easily maintainable in the devices of the relevant art. Therefore, a wall mountable device which retains elongated objects of various sizes and shapes is highly desirable yet currently unavailable in the relevant art.

SUMMARY

The various inventive embodiments described herein address the limitations of the relevant art and provides a mechanical arrangement which may be used to store elongated objects. In a first general aspect, a weight actuated storage device is provided. The weight actuated storage device comprises an elongated frame member having an upper end, a lower end, and a fixed pivot pin disposed proximate to its upper end. First and second lever members and are pivotally coupled to the pivot pin at their respective top ends and to a first and a second arm member at their respective bottom ends. The first and second arm members being upwardly and outwardly aligned in opposing relation such that their bottom ends intersect at a cross point along a longitudinal axis of the elongated frame member subjacent to the pivot pin.

The first and second arm members each include a perpendicular grasping member configured to laterally grasp an elongated object from a side when a longitudinal force is received at the cross point. A base support member is restively disposed in proximity to an opposite end of the elongated frame member and is communicatively coupled with the cross point of the first and second arm members. The base support member includes a platform aligned perpendicularly to the longitudinal axis of the elongated frame member and is configured to transmit the longitudinal force to the cross point when the elongated object is placed upon the platform for storage.

A motion damping device is provided for damping the longitudinal force between the cross point and the base support member. The transmitted longitudinal force causes the first and second arm members to move in unison inwardly toward the longitudinal axis of the elongated frame member until the elongated object is laterally grasped on opposing sides by each perpendicular grasping member.

In a related aspect, a motion damping device provides damping between the base support member and the cross point. The motion damping device is configured to dampen the rate of movement of the grasping members in response to the weight being placed on or removed from the top surface of the base support member. The motion damping device may be of an automotive type shock absorber.

In another related aspect, the grasping members include inward facing curved surfaces configured to grasp one or more rounded edges associated with the elongated object disposed there-between.

In a yet another related aspect, the grasping members include resilient surface padding disposed on at least opposing faces. In still another related aspect the elongated object is a recreational board, for example, skis, wake boards, boogie boards, surfboards, windsurfing boards, and skim boards.

In still another related aspect, the elongated frame member further includes a two or more openings periodically placed to allow the weight actuated storage device to be attached to a wall or other suitable vertical support structure using fasteners such as nails and/or screws.

BRIEF DESCRIPTION OF DRAWINGS

The features and advantages of the invention will become apparent from the following detailed description when considered in conjunction with the accompanying drawings. Where possible, the same reference numerals and characters are used to denote like features, elements, components or portions of the disclosed exemplary embodiments. It is intended that changes and modifications can be made to the described exemplary embodiments without departing from the true scope and spirit of the inventive scope as defined by the claims.

DETAILED DESCRIPTION

Figure 1:
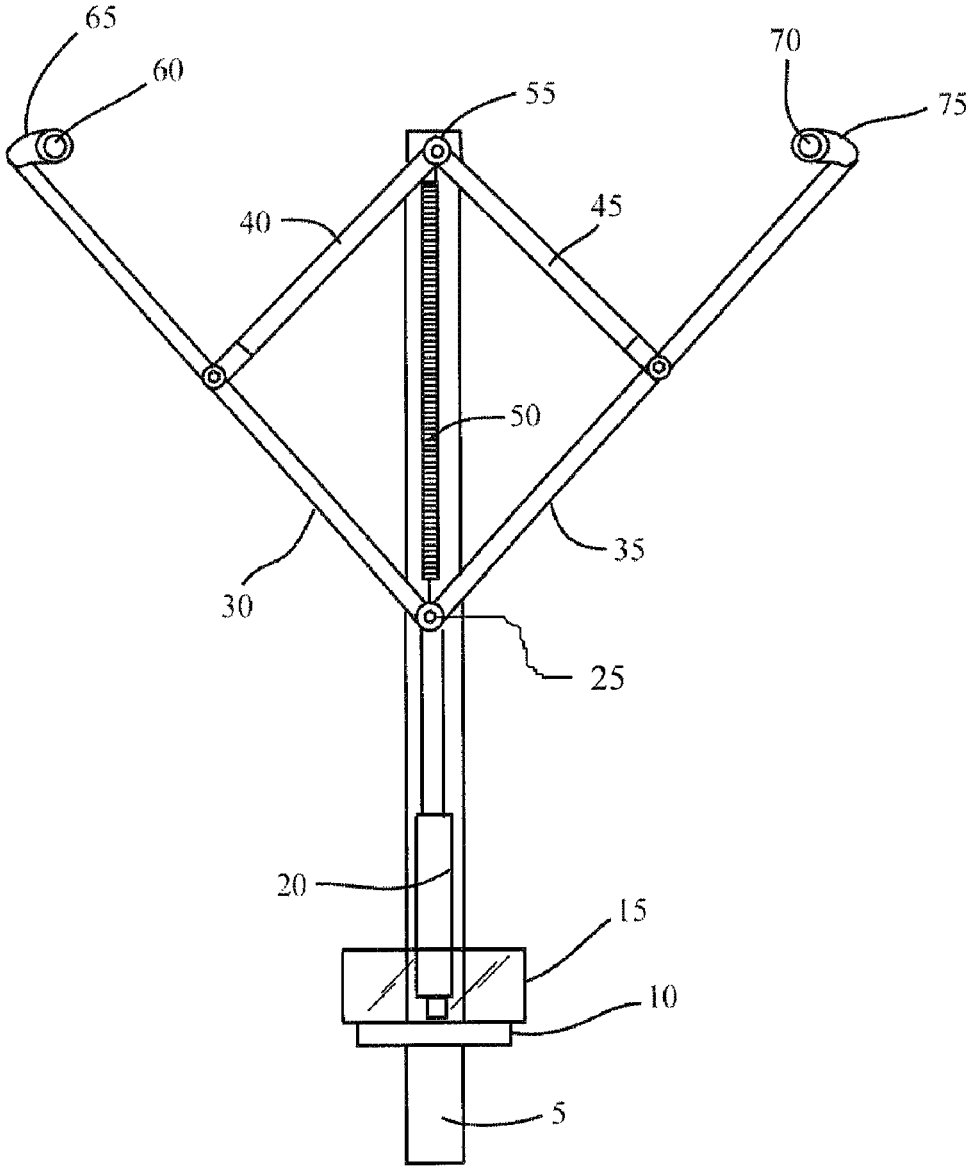
FIG. 1—depicts a generalized frontal view of an exemplary embodiment of the weight actuated storage device.

The various exemplary embodiments described herein provide a weight activated storage apparatus for maintaining an elongated object. Referring to FIG. 1, a front view of the weight actuated storage device is provided. The weight actuated storage device is comprised of an elongated frame member 5 which provides the base foundation for the remaining components. The elongated frame member 5 is intended to be mounted generally in a vertical plane to minimize the storage area required and also to maximize the use of gravity for activating the retaining features.

The elongated frame member 5 is envisioned to be constructed from a relatively lightweight metal or high impact plastic strip having sufficient weight bearing capabilities to support elongated objects to be stored in the weight actuated storage device. In proximity to the bottom end of the elongated frame member 5, a base support member 10 is provided for resting an elongated object thereupon to operate the clamping mechanism described below. The base support member 10 is slidably mounted perpendicularly to a longitudinal axis of the elongated frame member 5. In one embodiment, a longitudinal guide is provided to axially retain a motion damping device 20 coupled to the base support member 10 (not shown.)

In one embodiment, a separate "U" or "L" shaped channel member 15 may be coupled to the base support member 10 to assist in maintaining the elongated object 400 (FIG. 4) securely on the base support member 10. When so equipped, the "U" or "L" shaped channel member 15 is affixed to the base support member 10 by common fasteners such as screws or rivets. The "U" or "L" shaped channel member 15 is likewise envisioned to be constructed from lightweight metal or high impact plastic sufficient to maintain an elongated object 400 (FIG. 4) within the weight actuated storage device.

A longitudinally mounted motion damping device 20 is provided to damp the closing and opening of motions of the weight actuated storage device for both safety reasons and minimizing the possibility of damage to elongated objects 400 (FIG. 4) secured by the weight actuated storage device. In an embodiment, the motion damping device 20 comprises a suitably sized automotive type shock absorber. The motion damping device 20 is attached at the lower end to a bracket (not shown) located on a top surface of the base support member 10. The upper end of the motion damping device 20 is attached to a cross point 25 in which the lower ends of the first and second arm members 30, 35 intersect.

The cross point 25 allows the first and second arm members 30, 35 to pivot about a common rotation point without being restricted in longitudinal motion. The cross point 25 may be constructed from a shank bolt which traverses a lateral opening at the top of the motion damping device 20. Other simple lock and pin arrangements may be utilized as well. The first and second arm members 30, 35 are aligned at upwardly and outwardly directed acute angles to the longitudinal axis of the elongated frame member 5. The first arm member 30 assumes a leftward directed alignment while the second arm member 30 assumes a rightward directed alignment.

A first lever member 40 is pivotally coupled at its lower end to about a midpoint of the first arm member 30 and pivotally coupled at its upper end to a pivot pin 55 attached to the upper end of the elongated frame member 5. Likewise, a second lever member 45 is pivotally coupled at its lower end to about a midpoint of the second arm member 35 and pivotally coupled at its upper end to the pivot pin 55 attached to the upper end of the elongated frame member 5. The first and second lever members 35, 45 and the first and second arm members 30, 40 are likewise envisioned to be constructed from lightweight metal or high impact plastic sufficient to maintain an elongated object 400 (FIG. 4) within the weight actuated storage device.

A tension device 50 is longitudinally coupled to both the pivot pin 55 and cross point 25. The tension device 50 is intended to provide an upward longitudinal counterforce which maintains the first and second arm members 30, 35 in a receptive position for placement of the elongated object 400 into the retention device. The elongated object 400 (FIG. 4) is maintained within the retention device by a pair of grasping members 60, 70 perpendicularly coupled to the upper ends of the first and second arm members 30, 35. The grasping members 60, 70 are aligned in opposition to one another such that movement of the first and second arm members 30, 35 causes the grasping members 60, 70 to move in unison laterally inward or outward, depending on whether the elongated object 400 is being placed into or removed from the weight actuated storage device.

In an exemplary embodiment, the grasping members 60, 70 are provided with a resilient covering 65, 75 to prevent damage to the elongated object held therebetween. In another related exemplary embodiment, the grasping members 60, 70 are provided with inward facing arcuate contours to better grasp rounded edges which may be associated with the elongated object to be stored in the weight actuated storage device.

Figure 2:
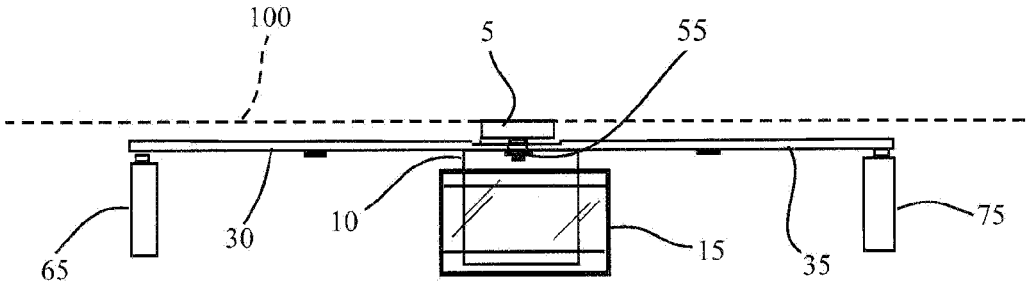
FIG. 2—depicts a top view of an exemplary embodiment of the weight actuated storage device.

FIG. 2 depicts a top view of an exemplary embodiment of the weight actuated storage device. In this view, the elongated frame member 5 is shown affixed to a wall 100 or other suitable vertical support structure. Also visible in this view are the base support member 10, the "U" or "L" shaped channel member 15, first and second arm members 30, 35, pivot pin 55, base support member 10, and the grasping members 60, 70 provided with the resilient covering material 65, 75.

Figure 3:
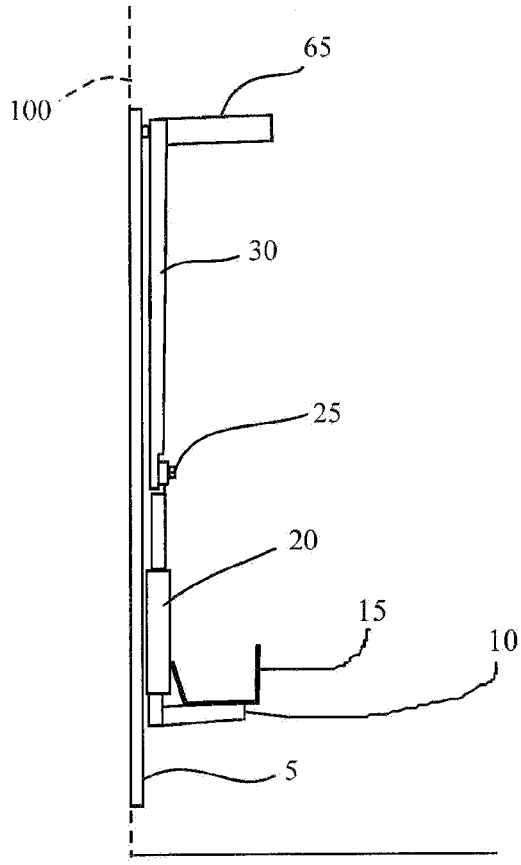
FIG. 3—depicts a side view of an exemplary embodiment of the weight actuated storage device.

FIG. 3 depicts a side view of an exemplary embodiment of the weight actuated storage device. In this view, the elongated frame member 5 is again shown affixed to a wall 100 or other suitable vertical support structure. Also visible in this view are the base support member 10, the "U" or "L" shaped channel member 15, the first arm member 30, a grasping member 60 with a resilient covering material 65, the cross point 25, the "U" or "L" shaped channel member 15 and base support member 10.

Figure 4:
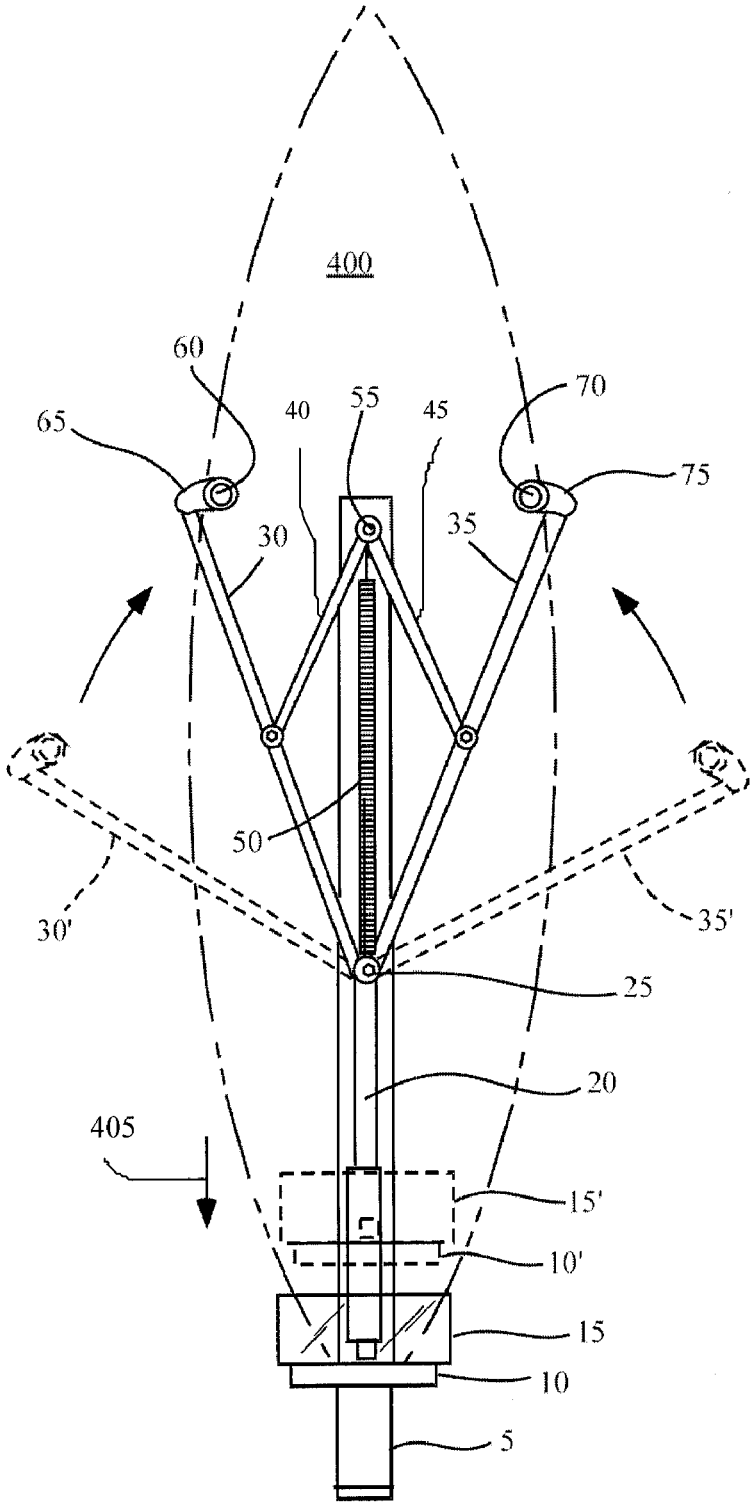
FIG. 4—depicts another exemplary frontal view of the weight actuated storage device having an elongated object stored therein.

FIG. 4 depicts another frontal view with an elongated object 400 (FIG. 4) being maintained by the weight actuated storage device. In this exemplary embodiment, the elongated object 400 is depicted as a surfboard. One skilled in the art will appreciate that any elongated recreational type boards may be stored using the weight actuated storage device. When the elongated object 400 is placed upon the base support member 10, the weight of the elongated object 400 overcomes the upward counterforce provided by the tension device 50 and causes the first and second arm members 30', 35', and associated grasping members 60', 70' and resilient covering material 65', 75' to move inward toward a longitudinal axis of the elongated frame member 5 until the grasping members 60, 70 and resilient covering material 65, 75 engage the lateral surfaces of the elongated object 400. The grasping force applied to the lateral surfaces of the elongated object 400 is a function of the weight of the elongated object 400 less the counterforce exerted by the tension device 50.

The "U" or "L" shaped channel member 15, 15' and base support member 10,10' move longitudinally downward until the grasping members 60', 70' and resilient covering material 65', 75' clamp the lateral surfaces of the elongated object 400. Once the grasping members 60', 70' and resilient covering material 65', 75' clamp the lateral surfaces of the elongated object 400, the "U" or "L" shaped channel member 15 and base support member 10 maintain a fixed geometry which provides a three point retention by way of the grasping members 60, 70, resilient covering material 65, 75 and base support member 10.

Figure 5:
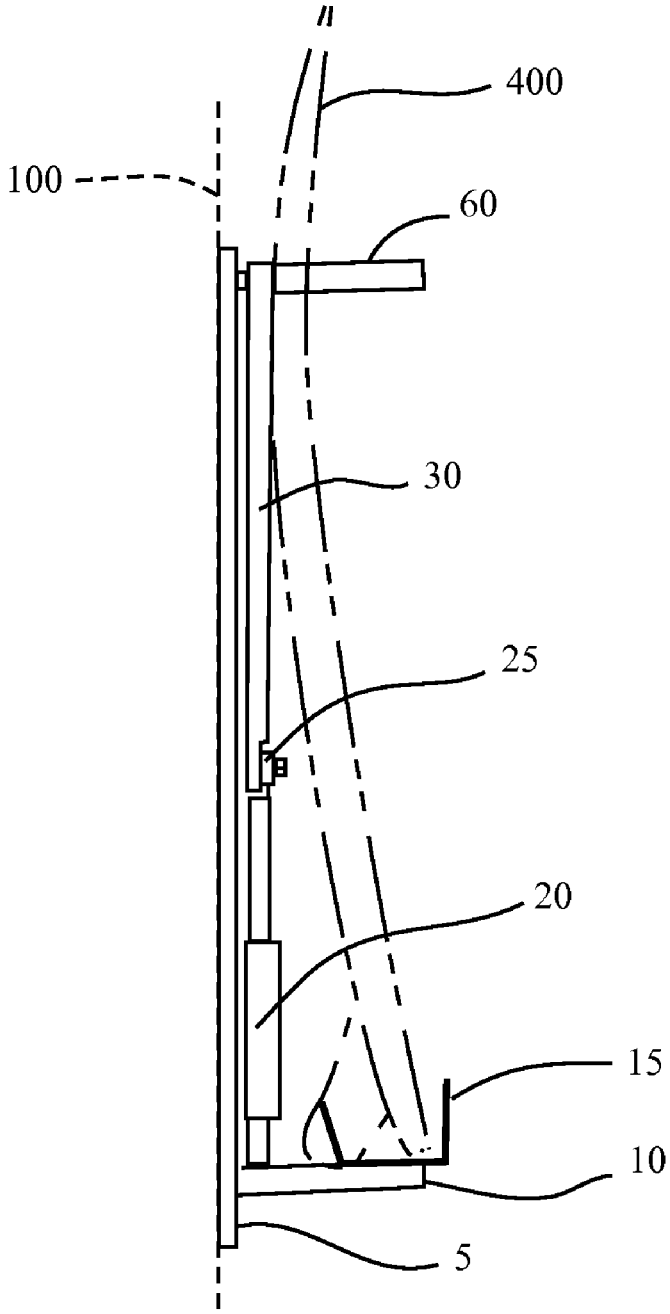
FIG. 5—depicts another exemplary side view of the weight actuated storage device having an elongated object stored therein.

FIG. 5 depicts another side view where the elongated object 400 of FIG. 4 (e.g., surfboard) is maintained in the three point retention by way of the grasping members 60, base support member 10 and the "U" or "L" shaped channel member 15 (if so equipped.) In this view, the elongated frame member 5 is again shown affixed to a wall 100 or other suitable vertical support structure. Also visible in this view are the first arm member 30, an associated grasping member 60 with a resilient covering material 65, the cross point 25, the "U" or "L" shaped channel member 15 and base support member 10.

Figure 6:
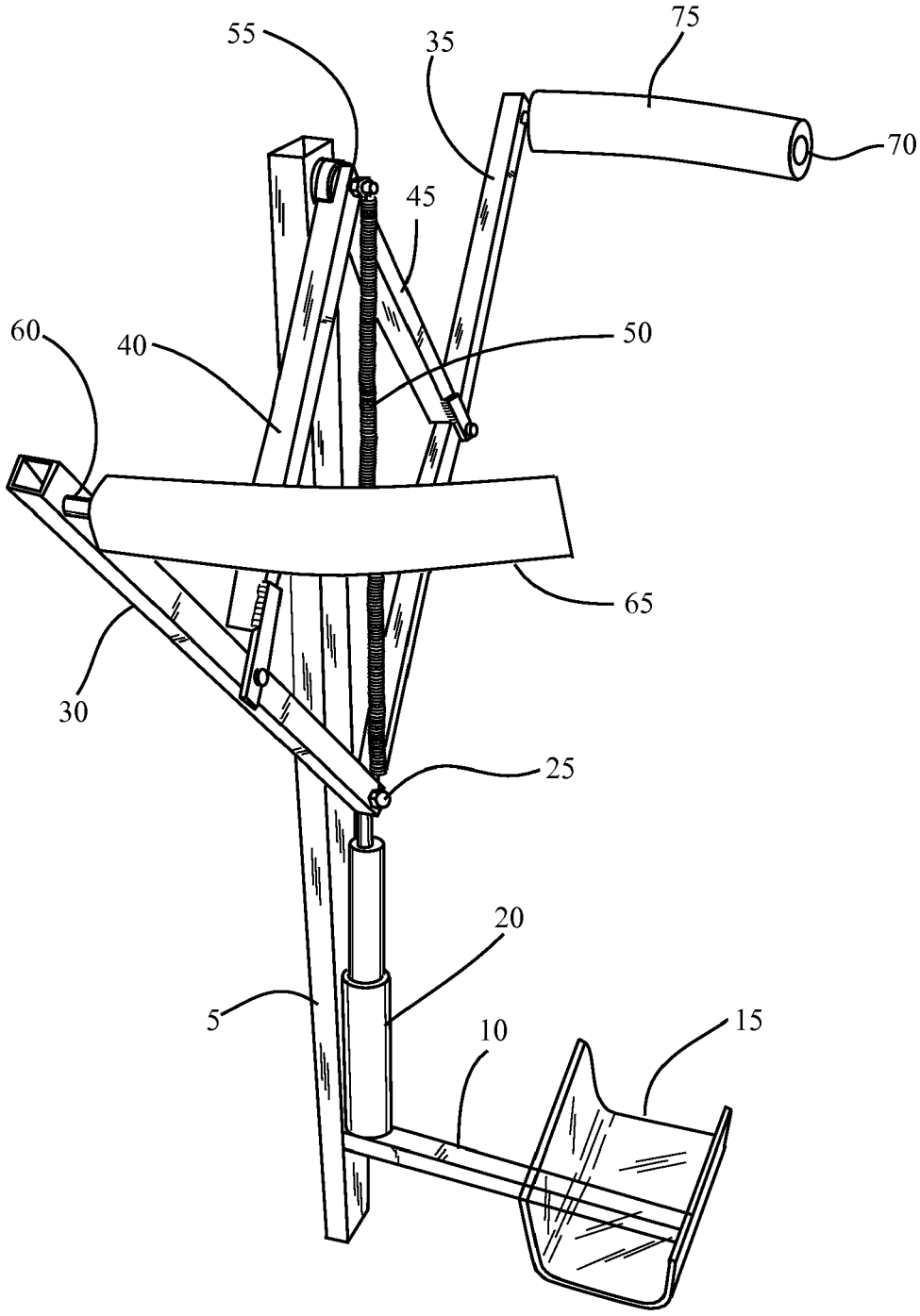
FIG. 6—depicts an exemplary perspective view of an embodiment of the weight actuated storage device.

FIG. 6 depicts a perspective view of an exemplary embodiment of the weight actuated storage device. In this exemplary embodiment, the weight actuated storage device is again depicted as being affixed to a wall 100 or other suitable vertical support structure by way of the elongated frame member 5. The base support member 5 is shown in this exemplary embodiment as a narrow bar which supports the "U" or "L" shaped channel member 15. The motion damping device 20 is longitudinally affixed to the base support member 5 at its bottom end and to the cross point 25 at its top end. The first and second arm members 30, 35 are coupled to the cross point 25 at generally equal but opposite oblique angles at their respective lower ends. The first and second lever members 40, 45 are depicted being coupled on their lower ends to the first and second arm members 30, 35 respectively and to the pivot pin 55 near the top end of the elongated frame member 5.

The tension device 50 is longitudinally coupled to the cross point 25 at its bottom end and to the pivot pin 55 at its top end. The tension device 50 may be of any suitable type for example, a spring, elastic band and/or bungee cord. The grasping members 60, 70 are shown aligned in opposition and are perpendicularly coupled at about the upper ends of their respective first and second arm members 30, 35. The grasping members 60, 70 may be provided with resilient covering material 65, 75. The resilient covering material 65, 75 may be constructed from any suitable polymeric, elastomeric or foam materials sufficient to prevent damaging the lateral surfaces of a retained elongated object 400 (FIG. 4). Likewise, the load bearing components are envisioned to be constructed from a relatively lightweight metal or high impact plastic strip having sufficient weight bearing capabilities to support the type of elongated objects 400 (FIG. 4) to be stored in the weight actuated storage device.

In one exemplary embodiment (not shown), the tension device 50 and optionally the motion damping device 20 may be replaced by providing a main pulley at about the top of the elongated frame member 5 and at least a pair of pulleys disposed at about longitudinal midpoints along the elongated frame member 5 between the first and second lever members 40, 45 and the first and second arm members 30, 35. In this exemplary embodiment, cables are used to pull the respective first and second arm members 30, 35 inward in response to a weight being disposed on the base support member 10. The first and second lever members 40, 45 may be omitted in this exemplary alternate embodiment as well. One cable end is looped through a pulley which engages the first arm member 30. A second cable is looped through a pulley which engages the second arm member 35. The two cables are combined into a common cable which is looped through the main pulley and routed downward to connect to the cross point 25. A separate bar or the existing motion damping device 20 is then attached to the base support member 10 respectively.

OPERATION

Referring back to FIG. 4, in one embodiment, the weight actuated storage device is affixed to a vertical support structure, typically a wall 100 (FIG. 3). An elongated object, for example, a surfboard 400 is disposed on a base support member 10 such that the long axis of the surfboard is bracketed by the grasping members 60, 70. The weight of the surfboard 400 causes a downward longitudinal force 405 to be exerted on the base support member 10, 15 which displaces the base support 10', 15' from its restive position to supporting position. The base support member 10, 15 transmits the downward longitudinal force 405 via a motion damping device 20 to a cross point 25. The downward longitudinal force 405 is then mechanically transmitted by the first and second lever arms 40, 45 and the fixed pivot point 55 to the first and second arm members 30, 35. The transmitted mechanical force causes the first and second arm members 30, 35 to be pulled generally inward toward a longitudinal axis of the elongated frame member 5. The grasping members 60, 70 then engage the surfboard 400 in unison from opposing sides. The clamping force exerted by the grasping members 60, 70 is a function of the weight of the surfboard 400 disposed on the base support member 10. A tension device 50 is provided to maintain the first and second arm members 30', 35' laterally apart when the lateral force 405 is absent.

In one embodiment, the "U" or "L" shaped channel member 15, 15' is provided to maintain the bottom of the surfboard 400 on the base support member 10, 10' during storage and removal of the surfboard 400 from the weight actuated storage device. Removal of the surfboard 400 from the weight actuated storage device is accomplished by grasping both sides of the surfboard and lifting upward sufficiently to overcome the weight of the surfboard 400 disposed on the base support member 10, 10'. The tension device 50 causes the first and second arm members 30, 40 to move away from the sides of the surfboard, thus releasing the clamping action of the grasping members 60, 70. The damping device 20 prevents rapid movement of the first and second support arms 30, 40 during storage and removal operations. This feature minimizes the need of a person to manually control the speed in which the first and second supports arms 30, 40 move.

The foregoing described exemplary embodiments are provided as illustrations and descriptions. They are not intended to limit the inventive scope to any precise form and/or structure described. In particular, it is contemplated that functional implementation of the various embodiments described herein may be implemented using any common construction material, or tension device. No specific limitation is intended to a particular shape, contour, or angular relationships between the various components. Other variations and embodiments are possible in light of above teachings, and it is not intended that this Detailed Description limit the inventive scope but rather by the Claims following herein.

What is claimed:

1. A weight actuated storage device comprising:

grasping means for laterally grasping an elongated object in an opposing paired relationship;

motivating means for motivating the grasping means in response to receipt of a longitudinal force;

counterforce means for maintaining the grasping means available to receive the elongated object when the longitudinal force is absent;

damping means for damping longitudinal movement of the elongated object in response to the longitudinal force; and, lateral support means for supporting the elongated object and for transmitting the longitudinal force generated by a weight of the elongated object to the motivating means;

wherein the elongated object is a recreational board.

2. The weight actuated storage device of claim 1, wherein the grasping means comprises a pair of elongated arms, each elongated arm including a jaw member configured to clamp a side of the recreational board.

3. The weight actuated storage device of claim 2, wherein the motivating means comprises a pair of levers configured to move the pair of elongated arms toward a common longitudinal centerline until each jaw member engages the recreational board from opposite sides.

4. The weight actuated storage device of claim 2, wherein the counterforce means is a spring or elastic cord configured to provide a sufficient amount of tension to maintain the pair of elongated arms laterally apart when the longitudinal force is absent.

5. The weight actuated storage device of claim 1, wherein the damping means is a shock absorber in communication with the motivating means and with the lateral support means.

6. A weight actuated storage device comprising:

a pivot pin perpendicularly affixed to one end of an elongated frame member;

a first lever member and a second lever member pivotally coupled to the pivot pin at their respective top ends and to a first and a second arm member at their respective bottom ends;

the first and second arm members being upwardly and outwardly aligned in opposing relation such that their bottom ends intersect at a cross point along a longitudinal axis of the elongated frame member subjacent to the pivot pin;

the first and second arm members each including a perpendicular grasping member configured to laterally grasp an elongated object from opposite sides when a longitudinal force is received at the cross point; and, a base support member disposed in proximity to an opposite end of the elongated frame member; the base support member being communicatively coupled with the cross point of the first and second arm members;

the base support member including a platform aligned perpendicularly to the longitudinal axis of the elongated frame member and configured to transmit the longitudinal force to the cross point when the elongated object is placed upon the platform for storage;

a shock absorber for damping the longitudinal force between the cross point and the base support member.

7. The weight actuated storage device of claim 6, wherein the longitudinal force is generated by a weight associated with the elongated object when placed upon the platform for storage.

8. The weight actuated storage device of claim 6, further comprising a tension device longitudinally coupled to the pivot pin at one end and to the motion damping device at an opposite end.

9. The weight actuated storage device of claim 8, wherein the tension device is configured to urge the first and second arm members laterally apart when the longitudinal force is absent.

10. The weight actuated storage device of claim 8, wherein the tension device is a spring or an elastic cord.

11. The weight actuated storage device of claim 6, wherein each perpendicular grasping member includes an inward facing arcuate surface configured to grasp one or more rounded edges associated with the elongated object.

12. A weight actuated storage device comprising:

an elongated frame member;

a pivot pin perpendicularly affixed to at about an upper end of an elongated frame member;

a first lever member and a second lever member pivotally coupled to the pivot pin at their respective top ends and to a first and a second arm member at their respective bottom ends;

the first and second arm members being upwardly and outwardly aligned in opposing relation such that their bottom ends intersect at a cross point along a longitudinal axis of the elongated frame member subjacent to the pivot pin;

the first and second arm members each including a perpendicular grasping member configured to laterally grasp an elongated object from a side when a longitudinal force is received at the cross point;

a base support member disposed in proximity to an opposite end of the elongated frame member and communicatively coupled with the cross point of the first and second arm members;

the base support member including a platform aligned perpendicularly to the longitudinal axis of the elongated frame member and configured to transmit the longitudinal force to the cross point when the elongated object is placed upon the platform for storage; and, a motion damping device for damping the longitudinal force between the cross point and the base support member;

wherein the transmitted longitudinal force causes the first and second arm members to move in unison inwardly toward the longitudinal axis of the elongated frame member until the elongated object is laterally grasped on opposing sides by each perpendicular grasping member.

13. The weight actuated storage device of claim 12, further comprising a longitudinally aligned tension device coupled between the pivot pin and the cross point.

14. The weight actuated storage device of claim 12, wherein each grasping member includes a resilient surface padding disposed on at least a surface which engages the elongated object.

15. The weight actuated storage device of claim 12, wherein the elongated object is a recreational board.

16. The weight actuated storage device of claim 15, wherein the recreational board is one of; skis, a wake board, a boogie board, a surfboard, a windsurfing board, and a skim board.

17. The weight actuated storage device of claim 8, wherein the tension device is configured to urge the first and second arm members laterally apart when the longitudinal force is absent.

18. The weight actuated storage device of claim 13, wherein the tension device is a spring or an elastic cord.

19. The weight actuated storage device of claim 12, wherein each perpendicular grasping member includes an inward facing arcuate surface configured to grasp one or more rounded edges associated with the elongated object.

* * * * *